US005570862A

United States Patent [19]

Nugent

[11] Patent Number: 5,570,862

[45] Date of Patent: Nov. 5, 1996

[54] FOLDABLE REFUSE BAG HOLDER

[76] Inventor: John T. Nugent, 3958 Applegate Cir., Brandon, Fla. 33511-7985

[21] Appl. No.: 488,992

[22] Filed: Jun. 8, 1995

[51] Int. Cl.[6] ..... A63B 55/04

[52] U.S. Cl. ..... 248/97; 248/99; 248/101

[58] Field of Search ..... 248/97, 99, 101

[56] References Cited

U.S. PATENT DOCUMENTS

| | | | |
|---|---|---|---|
| 3,697,030 | 10/1972 | Schultz | 248/101 |
| 3,747,653 | 7/1973 | Ringer | 248/99 |
| 4,006,928 | 2/1977 | Beugin | 248/99 |
| 4,615,743 | 10/1986 | Bylenga | 248/99 |
| 5,222,536 | 6/1993 | Hodgdon et al. | 248/99 |

FOREIGN PATENT DOCUMENTS

| | | | |
|---|---|---|---|
| 567965 | 10/1975 | Switzerland | 248/101 |

*Primary Examiner*—Ramon O. Ramirez
*Assistant Examiner*—Willie W. Berry, Jr.
*Attorney, Agent, or Firm*—American Innovations, Inc.; Dorothy S. Morse

[57] ABSTRACT

A foldable, lightweight, bag holder which supports a refuse bag so that the mouth of the refuse bag is held fully open when the bag holder is placed in either a vertical or horizontal position. The bag holder is simple to use and allows a person to sweep leaves, grass clippings, trash or other debris directly into the horizontally positioned refuse bag without having to use his or her own hands, or the help of another person, to maintain the refuse bag mouth in a fully opened position.

6 Claims, 2 Drawing Sheets

FOLDABLE REFUSE BAG HOLDER

BACKGROUND - FIELD OF INVENTION

This invention relates to bag holders, specifically to lightweight, foldable holders for refuse bags which hold the mouth of a refuse bag open for use in a horizontal position so that leaves, grass clippings, trash or other debris may be directly swept into the open refuse bag. The foldable bag holder would also be usable in a vertical position.

BACKGROUND - DESCRIPTION OF PRIOR ART

Many types of bag holders are known and in use. Some have closed sides and a closed bottom, such as the conventional garbage can. Others have lightweight, open frames. Some are freestanding and others are designed to be attached to walls, doors, or poles inserted into the ground. Prior art bag holders are also known to be collapsible for storage. However, it is not known in this field to have a foldable bag holder with a "D" shaped bag support which would be simple to use and which also would maintain a supported refuse bag open in a horizontal position so that leaves, grass clippings, trash or other debris on the ground may be swept easily and directly into the open bag. Many prior art bag holders are contemplated for use in a vertical position. Although some might also be used in a horizontal position, their simplicity, effectiveness or ease of use in the horizontal position would be diminished. For example, a prior art bag holder having a rigid circular ring to support a refuse bag mouth open could maintain the bag mouth open in both vertical and horizontal positions. However, in a horizontal position the circular shape of the ring support would make it difficult and inefficient to directly sweep leaves, grass clippings, trash and other debris on the ground into the bag, as only a small portion of the circular ring supporting it would come in close contact with the ground. Many prior art bag holders with circular rings also have legs depending from the circular ring, or other means of ring support, which further limit the stability and effectiveness of the bag holder in a horizontal position. Another example of a prior art bag holder which could maintain a refuse bag mouth open in a horizontal position is a conventional garbage can. If the garbage can had a square opening it could allow the direct sweeping of leaves, grass clippings, trash and other debris into a supported refuse bag. However, a conventional garbage can is not collapsible for storage and it can be heavy and awkward to use. Mouths of refuse bags do not always fit securely over a square opening and may allow debris, such as heavy grass clippings, to get into the bottom of the can requiring it to be cleaned or emptied. Also, the closed sides and bottom of a smaller garbage can may diminish the fill capacity of a larger refuse bag.

Prior art bag holders known to be most closely related to the present invention include the bag holder disclosed in U.S. Pat. No. 4,312,489 to Paetzold (1982) wherein a horizontal ring and an elastic band support a collapsible bag, with a vertical pole supporting the ring. The Paetzold bag holder is contemplated for use in an upright position. A similar bag holder is disclosed in U.S. Pat. No. 3,866,872 to Burgess (1975) in which a bag is fastened with spring clips to a split circular portion. During use the split circular portion is slip fit into a multi-apertured head block and supported on a sectional standard. Although the slip fit attachment would allow the Burgess bag holder to be disassembled into component parts, the foldable bag holder of the present invention would be faster and simpler to prepare for storage. Also, the Burgess bag holder is contemplated for vertical use on a flat surface and, with its circular ring support, the Burgess bag holder would not be effective in a horizontal position for sweeping leaves, grass clippings, trash and other debris directly into a supported bag.

The collapsible bag holder disclosed in U.S. Pat. No. 3,627,242 to Vandermast (1971) is capable of being folded flat for storage. However, its circular top ring and legs depending therefrom prevent it from being effective in a horizontal position for the direct sweeping of debris into a supported bag. Another collapsible bag holder is disclosed in U.S. Pat. No. 4,664,455 to Greenhow (1987) in which a bag frame having both movable and fixed portions is mounted to the inside of a cupboard door. The Greenhow bag holder also has a ramp mounted on the cabinet floor which engages the bag frame to open and close it as the cupboard door opens and closes. It too is contemplated for vertical use and would be ill-suited for use in a horizontal position for direct sweeping of debris into a supported bag.

SUMMARY OF INVENTION - OBJECTS AND ADVANTAGES

It is a primary object of this invention to provide a holder for refuse bags which maintains the mouth of a refuse bag open for use in a horizontal position so that leaves, grass clippings, trash or other debris may be swept directly into the open bag. It is also an object of this invention to provide a refuse bag holder that is foldable for storage. A further object of this invention is to provide a lightweight refuse bag holder which is simple to use. It is also an object of this invention to provide an economical design for a refuse bag holder that is more easily manufactured than bag holders currently in use.

DETAILED DESCRIPTION OF PREFERRED EMBODIMENTS

Figure 1:
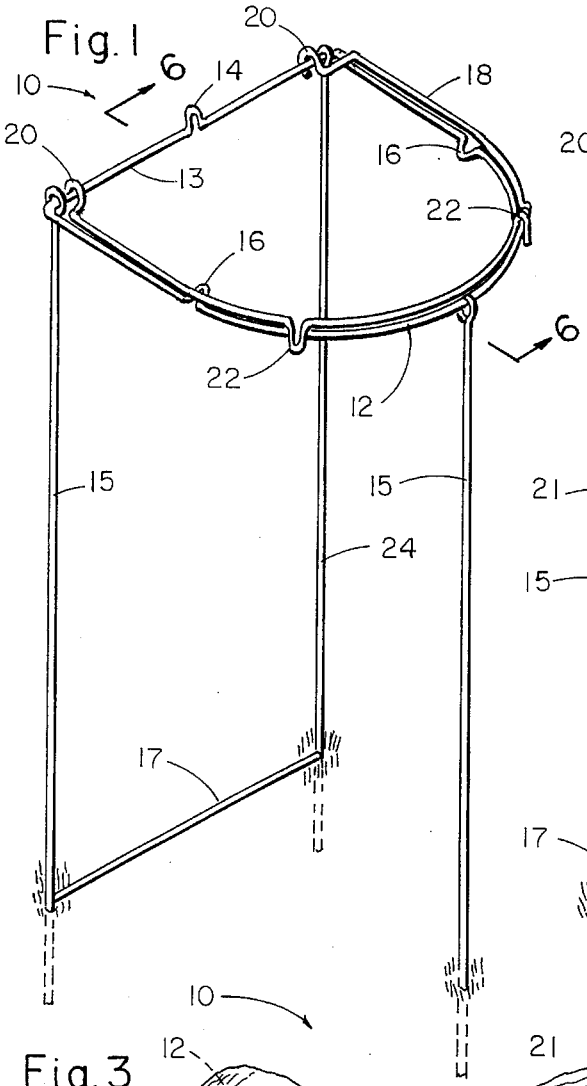
FIG. 1. is a perspective view of the invention as it would be used in a vertical position.
Figure 2:
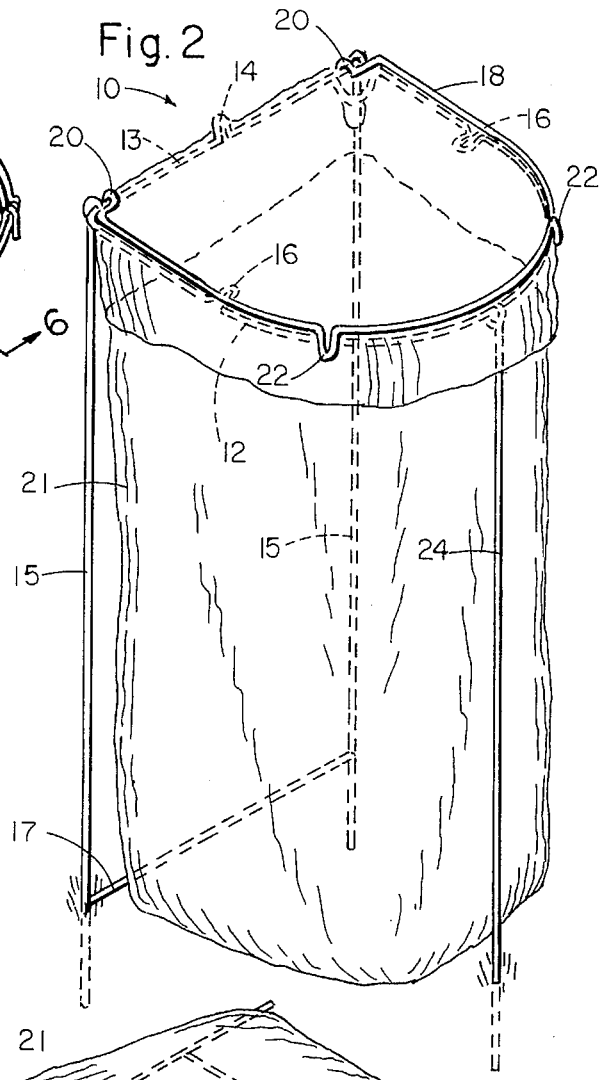
FIG. 2 is a perspective view, similar to FIG. 1, with a refuse bag installed upon the invention.

FIGS. 1 and 2 show refuse bag holder 10 made of wire and positioned vertically. At its upper end, refuse bag holder 10 has a closed wire loop 12 which is "D" shaped. Two wire legs 15 and a third movable wire leg 24 depend downward from closed wire loop 12 and may be inserted into the ground for stabilization. During use, closed wire loop 12 supports the open mouth of a refuse bag 21 "Although not shown, it is also contemplated for more than one moveable wire leg 24 to depend from closed wire loop 12."

FIG. 1 shows closed wire loop 12 having a horizontal base member 13. An inverted "U" shaped distention 14, located at the approximate center of horizontal base member 13, provides a means for storage by which refuse bag holder 10 may be attached to a nail or hook on a wall. Several inwardly disposed "U" shaped distentions 16 are also included on closed wire loop 12. Engagement of third movable wire leg 24 with one of inwardly disposed "U" shaped distentions 16 provides stabilization for closed wire loop 12 in a horizontal position. Stabilization is described further in the discussion of FIG. 3.

FIG. 2 shows a bale 18 securing refuse bag 21 over closed wire loop 12. Bale 18 has two open ends 20 which loop over opposite near end portions of horizontal base member 13. Additionally, bale 18 has a shape which conforms to the rounded portion of closed wire loop 12. The gripping capability of bale 18 is enhanced with a plurality of downwardly disposed wire distentions 22 which are shaped to snap securely over closed wire loop 12.

FIGS. 1 and 2 also show wire legs 15 each having a first end looped around opposite near end portions of horizontal base member 13. A horizontally disposed wire member 17 is attached to the near second end of each wire leg 15. Horizontally disposed wire member 17 secures each wire leg 15 to the other wire leg 15 for stabilization and limits the depth to which wire legs 15 may be inserted into the ground. Further stabilization is provided for wire legs 15 as the first end of each wire leg 15 is placed between opposite end portions of horizontal base member 13 and the adjacent looped attachment of open end 20 of bale 18. As a result, wire legs 15 are held in a relatively non-movable position, as opposed to third wire leg 24, also shown in FIGS. 1 and 2, which is movable along the rounded portion of closed wire loop 12.

Figure 3:
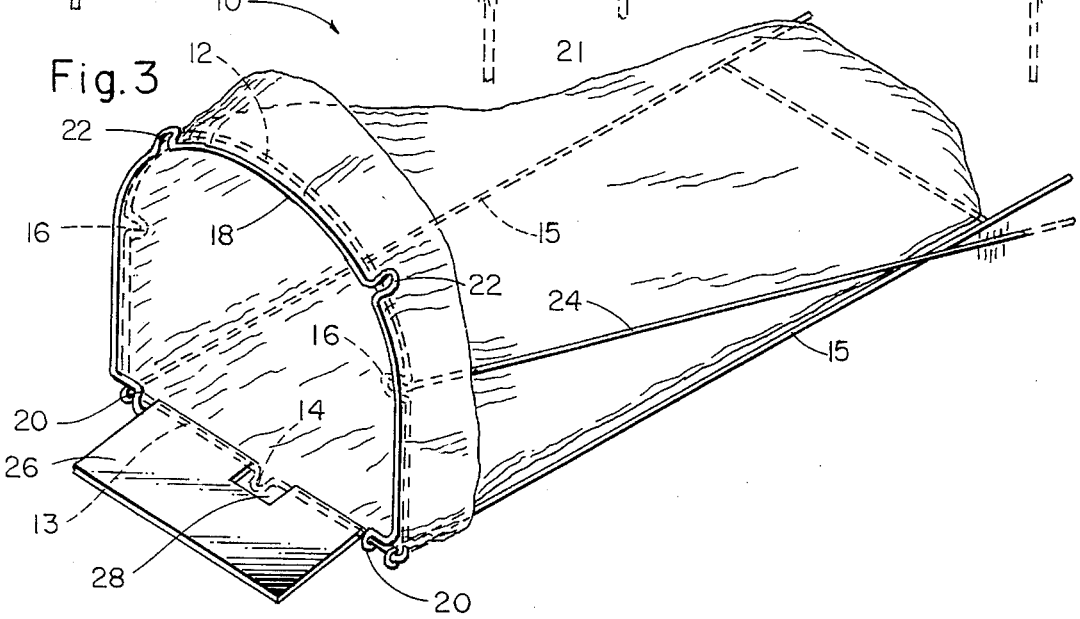
FIG. 3 is a perspective view of the invention in a horizontal position which allows direct sweeping of refuse into the refuse bag.

FIG. 3 shows refuse bag holder 10 in a reclined position. A detachable sweep ramp 26 is clipped onto horizontal base member 13, securing the open edge of refuse bag 21 therebetween. Sweep ramp 26 also has a notch 28 centrally located on the side clipped to horizontal base member 13. Notch 28 is of sufficient size and shape to accomodate inverted "U" shaped distention 14. FIG. 3 also shows the looped end of movable wire leg 24 positioned in one of inwardly disposed "U" shaped distentions 16 to stabilize closed wire loop 12 in a horizontal position. Further stabilization of refuse bag holder 10 in the horizontal position is achieved by inserting the unattached end of movable wire leg 24 into the ground.

Figure 4:
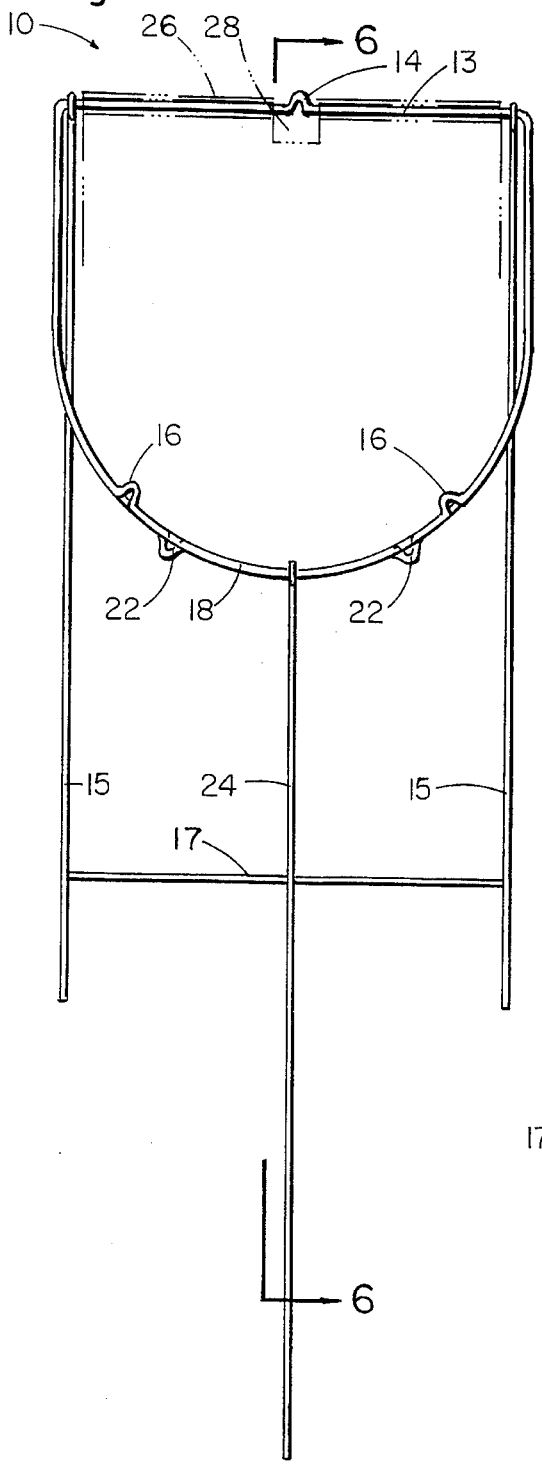
FIG. 4 is a frontal elevational view of the invention in its collapsed configuration for storage.
Figure 5:
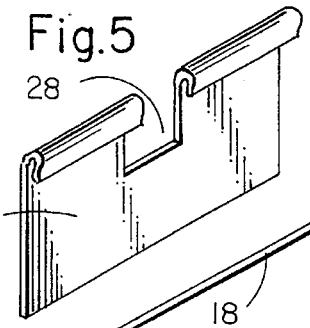
FIG. 5 is a perspective view of a detachable sweep ramp which facilitates the sweeping of debris into the/refuse bag.
Figure 6:
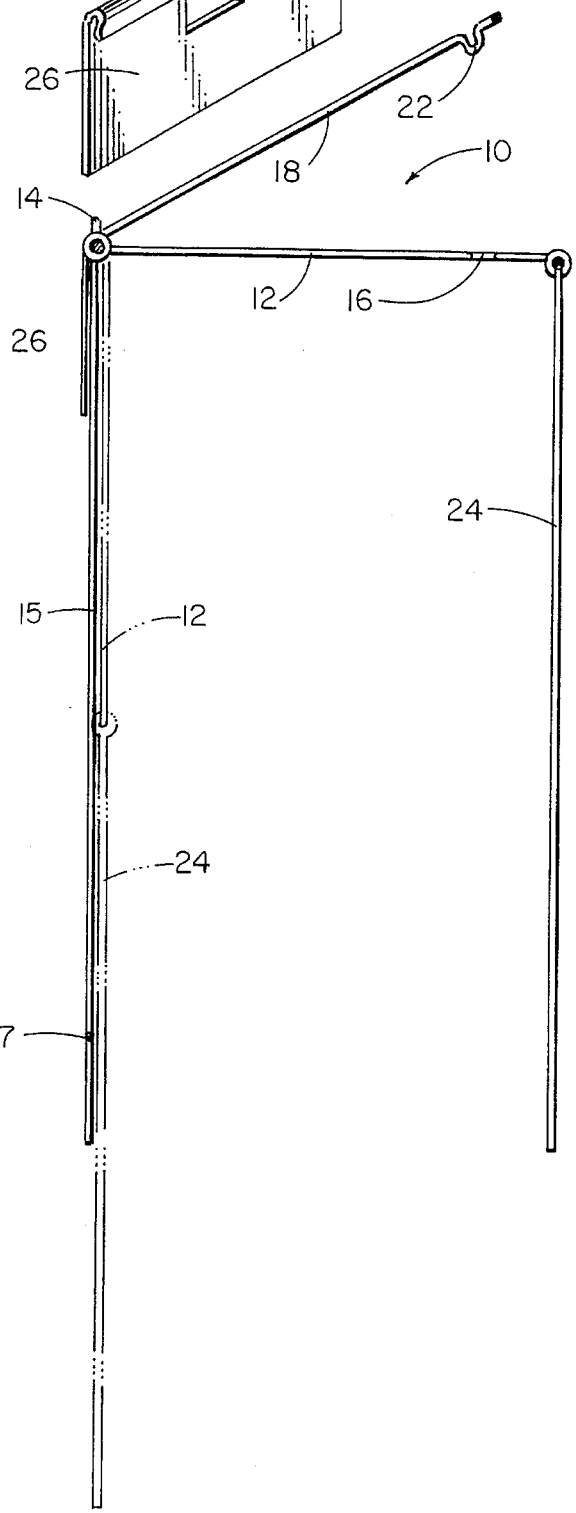
FIG. 6 is a combination cross-sectional view of the invention taken along the lines 6—6 of FIGS. 1 and 4.

FIGS. 4, 5 and 6 respectively show refuse bag holder 10 folded flat for storage, an enlargement of detachable sweep ramp 26 and a cross-sectional view of refuse bag holder 10 with bale 18 partially raised. To fold refuse bag holder 10 flat for storage, one must simply pick up refuse bag holder 10 by inverted "U" shaped distention 14. In doing so, closed wire loop 12, with bale 18 attached to it, will pivot forward into a position flat against wire legs 15. At the same time detachable sweep ramp 26 will pivot backward into a flat position against the opposite side of wire legs 15. Gravity will cause movable wire leg 24 to slide to the lowest point on the pivoted round portion of closed wire loop 12 and movable wire leg 24 will then hang flat against, and approximately perpendicular to, horizontally disposed wire member 17.

SUMMARY, RAMIFICATIONS AND SCOPE

As described herein, the present invention would provide a lightweight, foldable holder for refuse bags which would hold the mouth of a refuse bag open for use in a horizontal position so that leaves, grass clippings, trash or other debris may be directly swept into the open refuse bag. The foldable bag holder would also be usable in a vertical position. The present invention is simple to use and collapses easily into its folded configuration. Further, its economical design would permit it to be more easily manufactured than bag holders currently in use.

The above description provides preferred embodiments of the present invention but should not be construed as limiting the scope of the refuse bag holder. As the refuse bag holder could be made of lightweight materials other than wire, additional distentions could be used on the bag support loop, additional legs could be incorporated into the design and sweep ramp shapes other than those shown could be incorporated into the present invention, the scope of the present invention should be determined by the appended claims and their legal equivalents, rather than the examples given.

What is claimed is:

1. A foldable holder for supporting a refuse bag, said foldable holder comprising a "D" shaped loop having a flat portion contiguous with a rounded portion a plurality of legs each having one end pivotally depending from said "D"shape loop, means to secure said refuse bag to said "D" shaped loop, and means to stabilize said "D" shaped loop so that said foldable holder is stable in a horizontal position and able to maintain said refuse bag open for direct sweeping of debris into said open bag, wherein said means to secure said refuse bag to said "D" shaped loop comprises a bale pivotally attached to said flat portion of said "D" shaped loop, said bale having a shape conforming to said rounded portion of said "D" shaped loop, said bale also having a plurality of downwardly disposed continuous wire distentions which are capable of securely engaging said "D" shaped loop.

2. The foldable holder of claim 1 wherein said stabilization means comprises at least one of said legs being movable along said rounded portion of said "D" shaped loop, each of said movable legs having an unattached end opposite to said end pivotally depending from said "D" shaped loop, said rounded portion of said "D" shaped loop having a plurality of inwardly disposed "U" shaped distentions so that stabilization is accomplished when at least one of said movable legs engages one of said "U" shaped distentions while each of said opposite unattached ends of said movable legs which are engaged is inserted into the ground.

3. A foldable holder for a refuse bag comprising a "D" shaped loop having a flat portion contiguous with a rounded portion, a plurality of legs each having one end pivotally depending from said "D" shaped loop, a bale pivotally attached to said flat portion of said "D" shaped loop, said bale having a shape conforming to said rounded portion of said "D" shaped loop, said bale also having a plurality of downwardly disposed continuous wire distentions which are capable of securely engaging said "D" shaped loop to secure said refuse bag to said "D" shaped loop, a plurality of legs being movable along said rounded portion of said "D" shaped loop, each of said movable legs having an unattached end opposite to said end pivotally depending from said "D" shaped loop, said rounded portion of said "D" shaped loop having a plurality of inwardly disposed "U" shaped distentions, and at least one of said movable legs engaging one of said "U" shaped distentions while each of said opposite unattached ends of said movable legs is inserted into the ground to stabilize said foldable holder in a horizontal position and so that said foldable holder is able to maintain said refuse bag open for direct sweeping of debris therein.

4. The foldable holder for a refuse bag of claim 3 further comprising a sweep ramp attached to said flat portion of said "D" shaped loop so that refuse may more easily swept into said refuse bag when said foldable holder is in a horizontal position.

5. The foldable holder for a refuse bag of claim 4 wherein said sweep ramp is detachable.

6. The foldable holder for a refuse bag of claim 4 further comprising an inverted "U" shaped distention on said flat portion of said "D" shaped loop so that said foldable holder may be hung for storage.

* * * * *